US006324707B1

(12) United States Patent
Larsen et al.

(10) Patent No.: US 6,324,707 B1
(45) Date of Patent: Dec. 4, 2001

(54) PERSONAL SPA

(75) Inventors: Christopher Larsen, Vista; Raymond G. Smith, Los Angeles, both of CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/447,844

(22) Filed: Nov. 23, 1999

(51) Int. Cl.[7] ..... E04H 4/12; A47K 3/00

(52) U.S. Cl. ..... 4/541.1; 4/513; 4/584; 4/590; D23/277; D23/280.1

(58) Field of Search ..... 4/541.1, 513, 584, 4/589, 590; D23/277, 280.1

(56) References Cited

U.S. PATENT DOCUMENTS

| | | | | |
|---|---|---|---|---|
| D. 277,985 | * | 3/1985 | Kingsley | D23/277 |
| D. 323,701 | * | 2/1992 | Primucci et al. | D23/277 |
| D. 346,648 | * | 5/1994 | Levien | D23/277 |
| D. 349,560 | * | 8/1994 | Dowse et al. | D23/277 |
| D. 395,075 | * | 6/1998 | Kolada | D23/277 |
| D. 405,182 | * | 2/1999 | Larsen | D23/204 |
| D. 405,185 | * | 2/1999 | Larsen | D23/204 |
| D. 405,186 | * | 2/1999 | Larsen | D23/204 |
| D. 405,514 | * | 2/1999 | Donnelly | D23/280.1 |
| D. 425,606 | * | 5/2000 | Jones | D23/280.1 |
| 5,749,107 | | 5/1998 | Hansen et al. | 4/541.1 |

FOREIGN PATENT DOCUMENTS

Design 19092 6/1985 (NZ) .

* cited by examiner

*Primary Examiner*—Charles R. Eloshway
(74) *Attorney, Agent, or Firm*—Price & Gess

(57) ABSTRACT

A portable spa having three sides and including two seats disposed at an acute angle to one another and sharing a common footwell. Two of the sides of the spa meet at a right angle and one of the seats is disposed parallel to one of these two sides.

10 Claims, 3 Drawing Sheets

60
58
11
3
55
63
31
49
15
44
4
27
19
25
θ
13
17
B
41
61
29
C
θ1
53
A
47

11
60
23
21
30°
35°

PERSONAL SPA

BACKGROUND OF THE INVENTION

1. Field of the Invention

The subject invention relates generally to spas, whirlpools and the like and more particularly to a compact portable spa designed to seat two people.

2. Description of Related Art

Portable spas for relaxation and therapy have been available now for many years. Such spas typically feature numerous conveniences such as a self-contained equipment compartment, plug-in-the-wall operation, automatic programmed control of spa features, and relative overall ease of maintenance and use. Such portable spas have generally been designed to accommodate four or more people and have typically been either square or circular in configuration.

SUMMARY OF THE INVENTION

The subject invention relates to a unique spa construction, which accommodates two persons in adjacent seating areas disposed at an acute angle to one another. A particularly compact and convenient portable spa unit results, which may be placed in areas heretofore inaccessible to conventional portable spas.

BRIEF DESCRIPTION OF THE DRAWINGS

A preferred embodiment of the invention will now be described in detail in conjunction with the drawings of which.

DETAILED DESCRIPTION OF THE PREFERRED EMBODIMENTS

Figure 1:
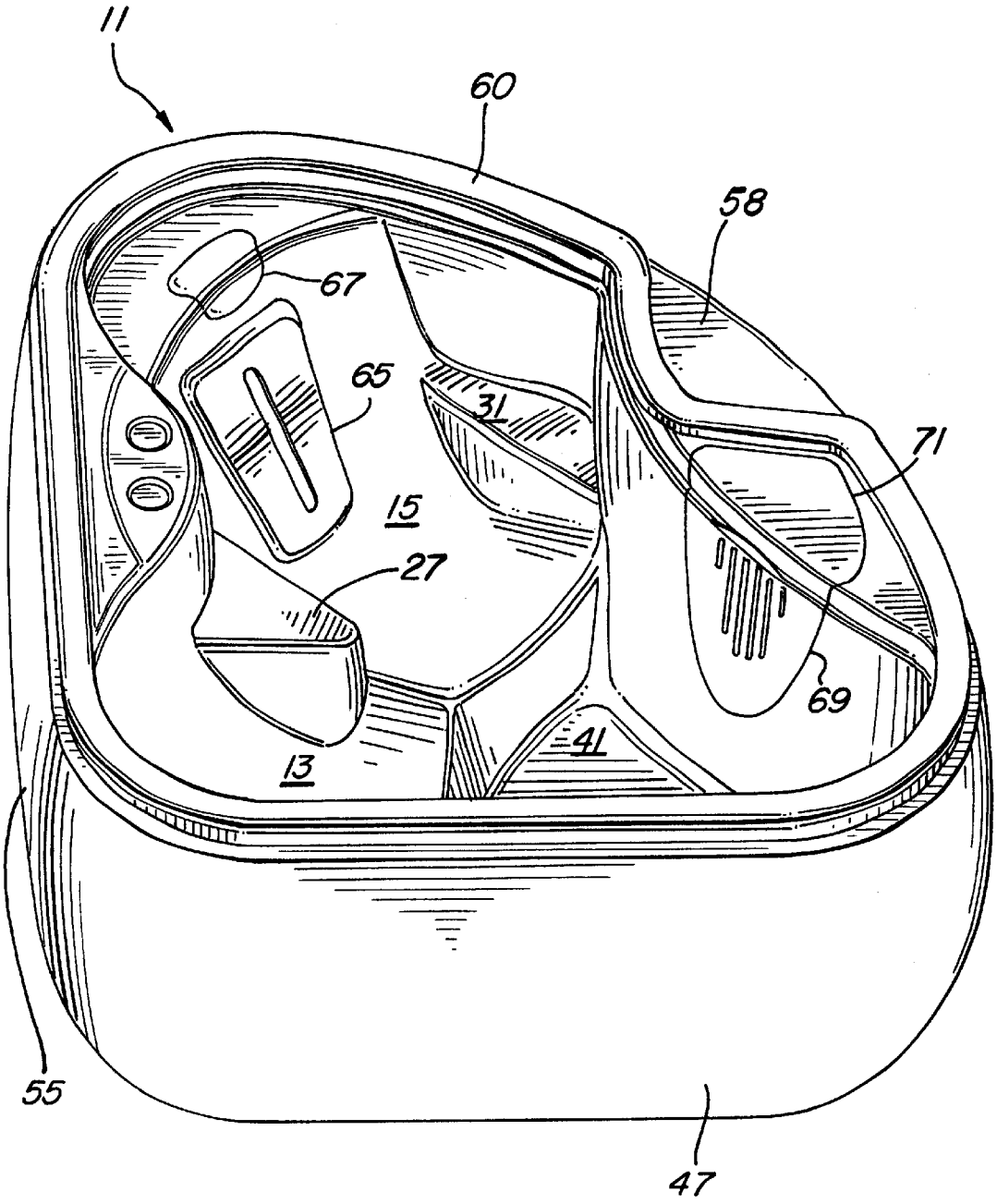
FIG. 1 is a perspective view illustrating a portable spa according to the preferred embodiment of the invention.
Figure 2:
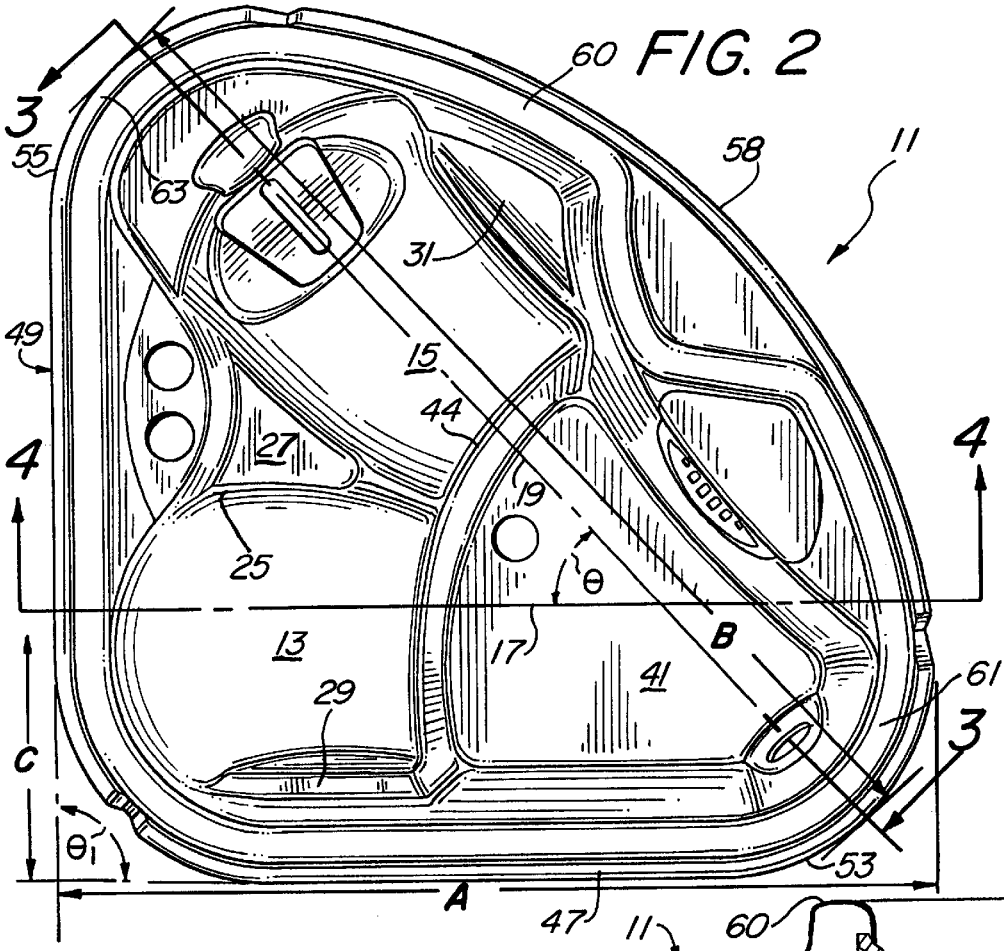
FIG. 2 is a top view of the spa of FIG. 1.

A portable spa 11 according to the preferred embodiment is illustrated in FIGS. 1–4. As may be seen, the spa 11 includes two adjacent seating areas 13, 15 disposed at an acute angle with respect to one another. In the particular embodiment of FIG. 1, the seating compartments are each shown bisected by respective dashed lines 17, 19 (FIG. 2). These bisectors 17, 19 meet at an acute angle θ. The angle θ may be, for example 43 degrees, but can obviously vary in different embodiments.

Figure 5:
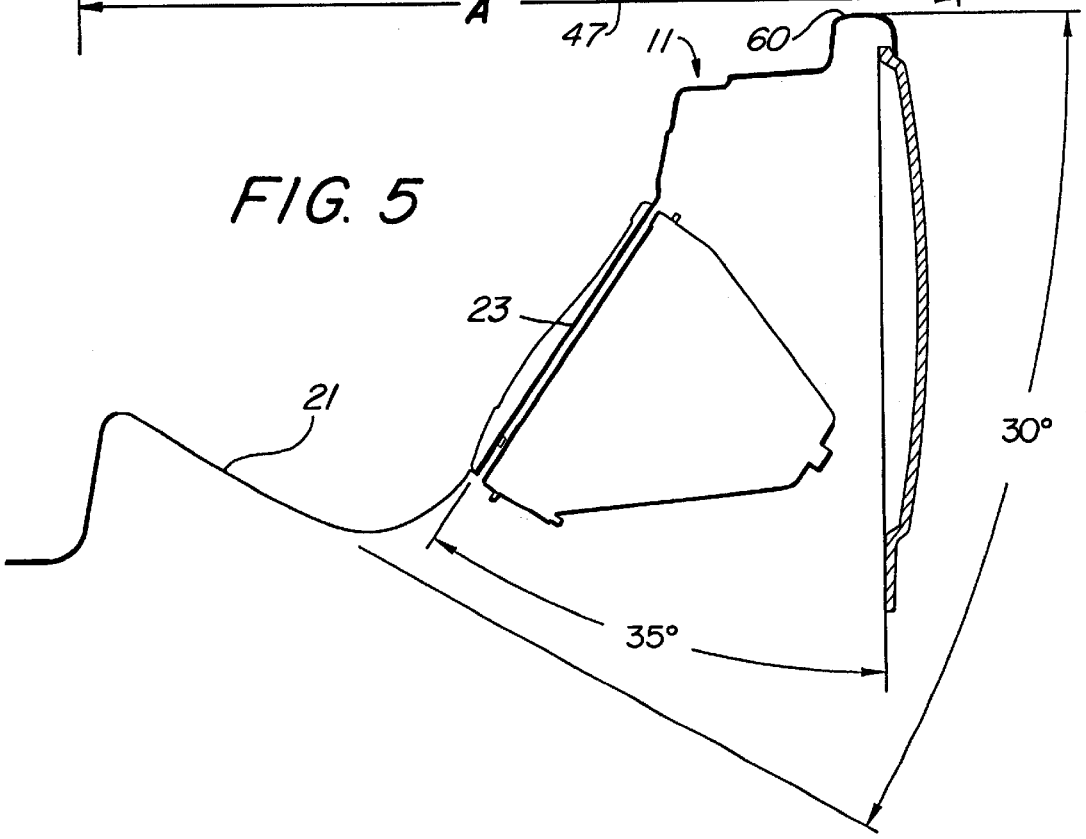
FIG. 5 is fragmentary side view illustrating seat detail according to the preferred embodiment.
Figure 3:
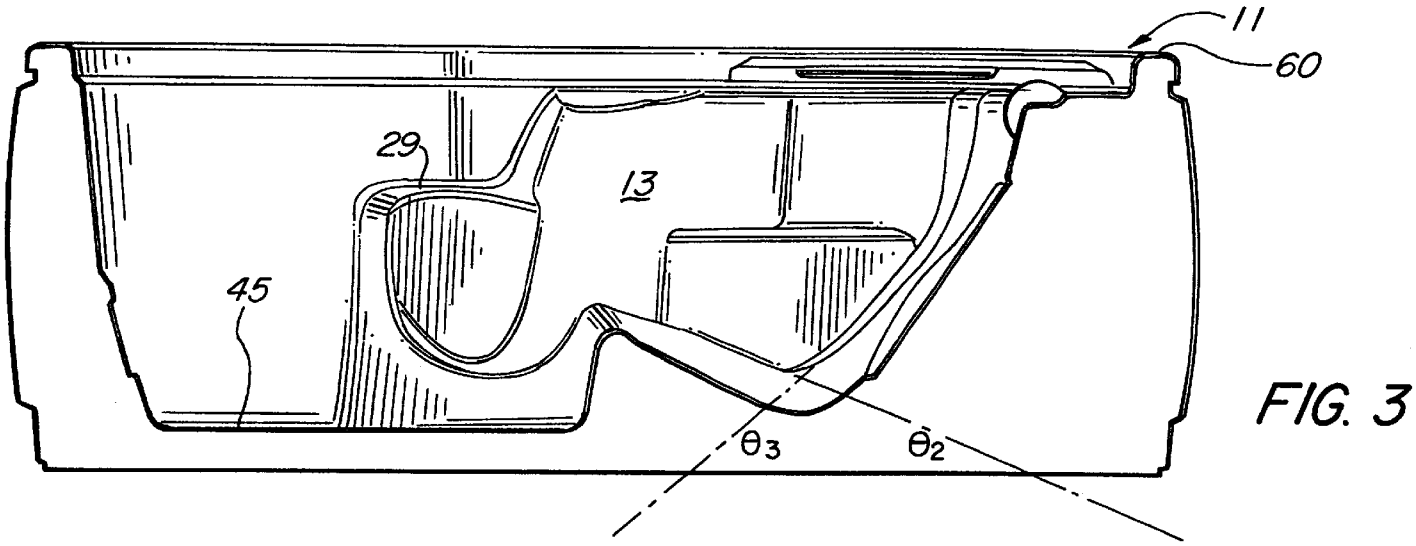
FIG. 3 is a sectional view taken at 3—3 of FIG. 2.
Figure 4:
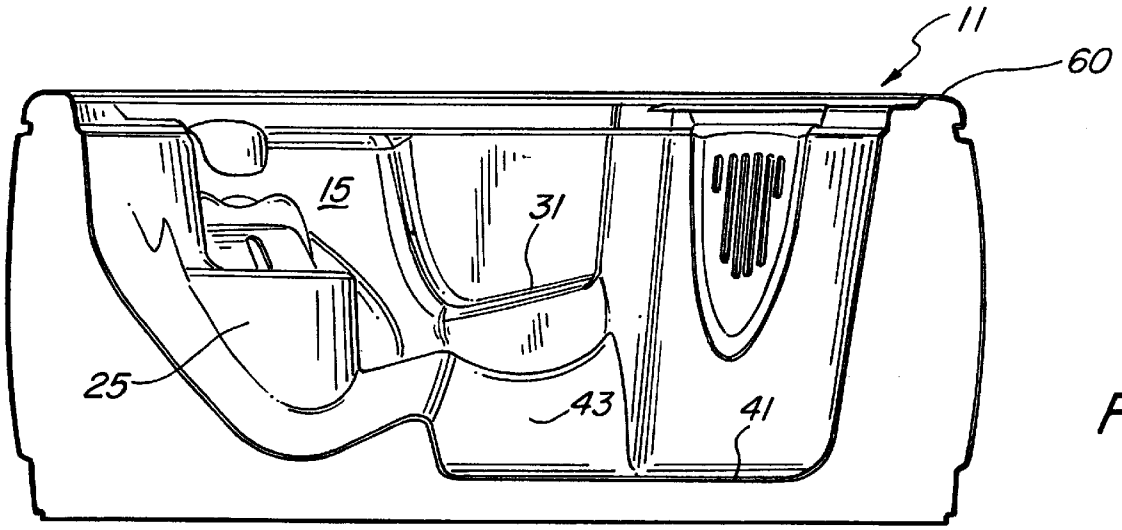
FIG. 4 is a sectional view taken at 4—4 of FIG. 2.

Each seating compartment 13, 15 features a rounded or "scooped out", bottom area, preferably shaped to comfortably accommodate respective users. As may be seen in FIGS. 3 and 4, each seat 13, 15 provides a reclined seating position. The reclined position of seat 13 is achieved in part via a base or seat portion 21 which is angled acutely to the horizontal and a back portion 23, which is angled back from a vertical or upright position. Representative angles for disposing the seat portions 21, 23 are shown in FIG. 5. Similar contouring is employed with respect to the second seat 15.

The seating areas 13, 15 may further be separated by a post 25 defined by respective inner, generally vertically disposed walls of the first and second seating areas 13, 15. The post 25 is truncated at a selected distance below the anticipated water level so as to form an arm rest surface 27 between the adjacent seats. Respective outer, generally flat-topped arm rest areas 29,31 are also provided on the respective outer sides 33, 35 of the seating areas 13, 15.

The spa interior preferably comprises a molded shell, as known to those skilled in the art. The shell may be fabricated for example by vacuum-form molding of a suitable shell material such as, for example, acrylic or other thermoplastic according to manufacturing techniques well-known to those skilled in the art.

As may be further seen in FIG. 2, the seating areas 13, 15 preferably share a common footwell area 41. This area 41 has a rear wall 43 defined by the slightly curved edge 44 of the seating areas 13, 15 and a flat bottom 45. The footwell area 41 is preferably sized to permit comfortable extension of the user's legs.

As further illustrated in FIG. 2, the outside of the spa 11 is comprised of two walls 47, 49, which meet at a right angle $\theta_1$ with one another and which meet in an arcuate corner 51. The bisector 17 lies parallel to the wall 47 as does the seating compartment 13. The respective far ends 53, 55 of the walls 47, 49 form into a third side 57 through respective curved wall portions 61, 63. The third side 57 is also gently curved, e.g. at a radius of 55 inches, but could of course be straight in alternative embodiments. The embodiment illustrated includes a rim 60 formed around its periphery.

The preferred embodiment thus provides a generally triangular or three-sided outer shape with rounded corners. A resultant "cozy", and compact spa results, which can be located in areas heretofore inaccessible by conventional portable spas.

Various accessories may of course be installed in conjunction with the spa such as various types of jets and headrest features. The spa 11 of FIG. 1 is shown equipped with a so-called moto jet 65 and accompanying head rest 67. The spa 11 further includes a weir compartment 69 over which lies a cover 71. The weir compartment forms part of the spa filtration mechanism and may provide space to accommodate filter cartridges and the like. A spa equipment compartment housing a pump, heater and other componentry may be located in the interior of the spa in the region 58 in FIG. 1. A control panel may be further located above this compartment 58. Typical outer dimensions for a spa 11 are A=64", B=78", and C=64".

From the above description, those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A spa comprising:

a first outer wall segment having a first and second end and being generally straight between the first and second end;

a second outer wall segment having a first and second end and being generally straight between the first and second end, the first end of the second wall segment and the first end of the first wall segment being joined together;

a third wall segment having a first and second end, the first end of the third wall segment being joined to the second end of the first wall segment, and the second end of the third wall segment being joined to the second end of the second wall segment;

whereby the wall segments form a continuous triangular-shaped outer wall;

a first seating area disposed within the triangular-shaped outer wall in the corner formed by the first end of the third wall segment and second end of the second wall segment, with its center-line aligned to lie along a line from the corner formed by the first end of the third wall segment and second end of the second wall segment to the corner formed by the second end of the third wall segment and the second end of the first wall segment;

a second seating area disposed within the triangular-shaped outer wall in the corner formed by the first end of the first wall segment and the first end of the second wall segment, with its center-line aligned to lie along a line parallel to the second wall segment; and a footwell adjacent a common edge of said first and second seating areas in the corner formed by the second end of the second wall segment and the second end of the third wall segment, the length of the footwell from the common edge of the seating areas along the center-line of the first seating area to the corner formed by the second ends of the second and third wall segments being greater than the length of the footwell from the common edge of the seating areas at the intersection of the center-line of the second seating area and the common edge to the corner formed by the second ends of the second and third wall segments, providing said first seating area with greater leg room than said second seating area.

2. The spa of claim 1 wherein said footwell has a flat bottom and a vertical wall at said common edge.

3. The spa of claim 1 wherein said second wall segment meets at a right angle with said first wall segment.

4. The spa of claim 1 wherein said first and second wall segments are of equal length.

5. The spa of claim 1 wherein said first and second seating areas have a scooped-out contour.

6. The spa of claim 1 wherein said first seating area comprises a seat that is reclined at an angle of about 30° from a horizontal, and a back that is reclined at an angle of about 35° from a vertical.

7. The spa of claim 6 wherein said second seating area comprises a seat that is reclined at an angle of about 30° from a horizontal, and a back that is reclined at an angle of about 35° from a vertical.

8. The spa of claim 1 further comprising:

a single common armrest between said first and second seating areas; and individual armrests along the sides of the first and second seating areas opposite the sides of the first and second seating areas along the common armrest.

9. The spa of claim 1 further comprising a weir compartment located along the third outer wall segment between its first and second end 5.

10. The spa of claim 9 further comprising a spa equipment compartment for a pump, heater and other components located along the third wall segment.

* * * * *

UNITED STATES PATENT AND TRADEMARK OFFICE

CERTIFICATE OF CORRECTION

PATENT NO. : 6,324,707 B1
APPLICATION NO. : 09/447844
DATED : December 4, 2001
INVENTOR(S) : Christopher Larsen et al.

It is certified that error appears in the above-identified patent and that said Letters Patent is hereby corrected as shown below:

Claim 1, Col. 3, line 5, delete second occurrence of the word "second" immediately before the word "wall" and insert therefore --first--, Line 5 should read:
"third wall segment and second end of the first wall"

Claim 1, Col. 3, line 8, delete second occurrence of the word "second" immediately before the word "wall" and insert therefore --first--. Line 8 should read:
"segment and second end of the first wall segment to"

Claim 1, Col. 3, line 10, delete "first" before the word "wall," and insert therefore --second--. Line 10 should read:
"segment and the second end of the second wall segment."

Signed and Sealed this

Twenty-sixth Day of August, 2008

JON W. DUDAS
*Director of the United States Patent and Trademark Office*